US008483601B2

(12) United States Patent
Saito et al.

(10) Patent No.: US 8,483,601 B2
(45) Date of Patent: Jul. 9, 2013

(54) TRANSFER FIXING DEVICE AND IMAGE FORMING APPARATUS INCORPORATING SAME

(75) Inventors: Kazuya Saito, Kanagawa (JP); Atsushi Nagata, Kanagawa (JP); Takashi Fujita, Kanagawa (JP); Takashi Seto, Kanagawa (JP); Hiromitsu Takagaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 586 days.

(21) Appl. No.: 12/659,433

(22) Filed: Mar. 9, 2010

(65) Prior Publication Data

US 2010/0232844 A1 Sep. 16, 2010

(30) Foreign Application Priority Data

Mar. 10, 2009 (JP) ..... 2009-055830

(51) Int. Cl.
*G03G 15/16* (2006.01)

(52) U.S. Cl.
USPC ..... 399/307

(58) Field of Classification Search
USPC ..... 399/307
See application file for complete search history.

(56) References Cited

U.S. PATENT DOCUMENTS

| | | | | |
|---|---|---|---|---|
| 7,031,648 | B2 | 4/2006 | Takashi et al. | |
| 7,127,202 | B2 | 10/2006 | Fujita et al. | |
| 7,139,520 | B2 | 11/2006 | Echigo et al. | |
| 7,177,580 | B2 | 2/2007 | Nakafuji et al. | |
| 7,233,762 | B2 | 6/2007 | Kunii et al. | |
| 7,254,362 | B2 | 8/2007 | Kikuchi et al. | |
| 7,299,003 | B2 | 11/2007 | Kurotaka et al. | |
| 7,551,882 | B2 | 6/2009 | Seto et al. | |
| 7,583,922 | B2 | 9/2009 | Takashi et al. | |
| 2004/0037595 | A1* | 2/2004 | Takashi et al. | 399/307 |
| 2005/0025534 | A1 | 2/2005 | Fujita et al. | |
| 2005/0025537 | A1 | 2/2005 | Echigo et al. | |
| 2005/0117943 | A1 | 6/2005 | Nakafuji et al. | |
| 2005/0152721 | A1 | 7/2005 | Kikuchi et al. | |
| 2005/0201783 | A1 | 9/2005 | Kurotaka et al. | |
| 2005/0207801 | A1 | 9/2005 | Kunii et al. | |
| 2006/0104678 | A1* | 5/2006 | Kuo et al. | 399/313 |
| 2008/0008505 | A1 | 1/2008 | Seto et al. | |
| 2008/0069610 | A1 | 3/2008 | Nakafuji et al. | |

(Continued)

FOREIGN PATENT DOCUMENTS

| | | |
|---|---|---|
| JP | 2002-099159 | 4/2002 |
| JP | 2004-145260 | 5/2004 |
| JP | 2005-037879 | 2/2005 |
| JP | 2011070040 A * | 4/2011 |

*Primary Examiner* — Walter L Lindsay, Jr.
*Assistant Examiner* — Ruth Labombard
(74) *Attorney, Agent, or Firm* — Harness, Dickey & Pierce P.L.C.

(57) ABSTRACT

A transfer fixing device includes a transfer fixing member, a pressure member, and a primary heater. The transfer fixing member defines a moving surface on which a toner image travels. The pressure member is pressed against the transfer fixing member to define a transfer fixing nip where the toner image traveling along the moving surface meets a surface of a recording medium traveling along the media conveyance path. The primary heater is located upstream of the transfer fixing nip along the media conveyance path to heat the surface of the recording medium before entering the transfer fixing nip. The heated surface of the recording medium fuses toner for transfer and fixing into place at the transfer fixing nip. The pressure member is at least partially electrically biased to generate an electrostatic field to promote transfer of toner at the transfer fixing nip.

18 Claims, 8 Drawing Sheets

U.S. PATENT DOCUMENTS

| | | | |
|---|---|---|---|
| 2008/0138124 | A1 | 6/2008 | Kikuchi et al. |
| 2008/0199229 | A1 | 8/2008 | Fujita et al. |
| 2008/0219716 | A1 | 9/2008 | Takashi et al. |
| 2008/0219717 | A1 | 9/2008 | Kayahara et al. |
| 2008/0219718 | A1 | 9/2008 | Fujita et al. |
| 2008/0292347 | A1 | 11/2008 | Koide et al. |
| 2009/0003898 | A1 | 1/2009 | Kayahara et al. |
| 2009/0016786 | A1 | 1/2009 | Suzuki et al. |
| 2009/0116880 | A1 | 5/2009 | Takagaki et al. |
| 2010/0014903 | A1 | 1/2010 | Seto et al. |

* cited by examiner

TRANSFER FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2009-055830, filed on Mar. 10, 2009, which is hereby incorporated by reference herein in its entirety.

BACKGROUND OF THE INVENTION

1. Field of the Invention

The present invention relates to a transfer fixing device and an image forming apparatus incorporating the same, and more particularly, to a transfer fixing device that simultaneously transfers and fixes a toner image into place on a recording medium, and an electrophotographic image forming apparatus, such as a photocopier, printer, facsimile, or multifunctional machine having several of those image imaging functions, incorporating such a transfer fixing device.

2. Discussion of the Background

In electrophotographic image forming apparatuses, such as photocopiers, facsimiles, printers, plotters, or multifunctional machines incorporating several of those imaging functions, an image is formed by electrostatically by attracting toner particles to a photoconductive surface. After image formation, the powder toner image is transferred to a recording medium such as a sheet of paper, followed by a fixing process that permanently fixes the toner image in place by melting and settling toner with heat and pressure.

Various types of electrophotographic systems are known in the art, some of which employ a simultaneous transfer fixing or "trans-fixing" process that simultaneously transfers and fixes a toner image into place on a recording sheet. Typically, a trans-fixing device uses a trans-fixing belt or cylinder with a heated, moving surface on which a powder toner image travels from where it is formed or intermediately transferred, and a pressure member pressed against the trans-fixing member to define a trans-fixing nip where the toner image meets a recording sheet traveling through a sheet conveyance path. Upon entering the trans-fixing nip, the toner image melts and settles onto the recording sheet under heat and pressure, and subsequently cools and solidifies to obtain a finalized image.

One advantage of using a trans-fixing process in electrophotographic printing is that it accommodates use of smooth recording media as well as rough recording media with surface roughness or vertical irregularities on the order of several micrometers.

In an electrostatic transfer device separate from a thermal fixing process which transfers toner from a transfer member to a recording sheet under an electrostatic bias field, printing on rough paper results in the transfer member failing to conform to the microscopic surface irregularities of the recording sheet. This creates minute gaps between the transfer member and paper surface, which affect proper formation of the electrostatic bias field and hence proper transfer of toner to desired portions of the recording sheet, causing loss of detail and a grainy, fuzzy appearance of a resulting print.

By contrast, a trans-fixing device can render toner particles into a viscoelastic mass on a trans-fixing member with heat during simultaneous transfer and fixing, which readily transfers in an image configuration onto a recording sheet even across minute gaps present within the trans-fixing nip. Such thermally-assisted transfer yields an extremely clear, sharp image regardless of whether the recording sheet in use is smooth or rough.

Another advantage of using trans-fixing process is that it allows a high degree of flexibility in designing the sheet conveyance path along which a recording sheet is fed through the electrophotographic system.

Conventionally, designing a sheet conveyance path extending from transfer to fixing units involves a concern that an unfixed, powder toner image smears or rubs off when the recording sheet bearing it encounters surrounding structures between the transfer and fixing processes. This places constraints on the design of equipment for guiding recording sheets in the sheet conveyance path, making it difficult to provide an electrophotographic system with effective sheet conveyance performance.

Such concern is obviated by using simultaneous transfer and fixing in place of separate transfer and fixing processes. That is, with a trans-fixing unit that performs both transfer and fixing within a trans-fixing nip, an image forming apparatus can convey a recording sheet therethrough without exposing an unfixed image to neighboring structures. This allows a wide range of designs to become available for effective sheet conveyance, leading to increased efficiency and productivity of an image forming apparatus incorporating the trans-fixing unit.

Owing to such advantages over separate transfer and fixing, the trans-fixing method has found application in high-quality color printers accommodating a wide range of recording media with consistent, and consistently superior, imaging quality. However, with growing demands for energy-efficient products with even greater performance, severe requirements are currently imposed on those trans-fixing printers in terms of thermal efficiency and compatibility with extremely rough recording media.

As mentioned above, a typical trans-fixing device fuses toner on a heated surface of a trans-fixing member traveling from where a toner image is formed or intermediately transferred from another surface to where the toner image is transferred to a recording sheet (i.e., the trans-fixing nip). Heating the trans-fixing member can thus result in a significant amount of heat absorbed and lost over the length of trans-fixing member, particularly where the trans-fixing surface has a substantial thickness for obtaining durability, or, as in the case of tandem color printers, a substantial length for traveling across multiple imaging units. Such heat loss becomes even more pronounced where the trans-fixing member is cooled downstream of the trans-fixing nip to prevent thermally-induced damage to components arranged along the endless travel path, resulting in large amounts of energy lost in the repeated thermal cycle.

Moreover, although simultaneous transfer and fixing operates well with rough recording media compared to electrostatic transfer separate from thermal fixing, it can encounter a decrease in transfer efficiency when the recording medium in use has an extremely rough surface with irregularities on the order of 30 micrometers or more. This results in inconsistent image resolution and definition, and a limited range of recording media accommodated in an image forming apparatus incorporating the trans-fixing process.

Both of these current requirements should be met to provide a successful trans-fixing device for application to today's high quality electrophotographic systems. The thermal energy issue can be alleviated by providing a supplementary heater that heats a recording medium upstream of the trans-fixing nip to minimize an amount of heat applied to a trans-fixing member for simultaneous transfer and fixing. However, such alleviation is not fully exploited in the art, and no effective solution has been proposed to address the requirement of compatibility with extremely rough recording media.

SUMMARY OF THE INVENTION

Exemplary aspects of the present invention are put forward in view of the above-described circumstances, and provide a novel transfer fixing device that simultaneously transfers and fixes a toner image into place on a recording medium.

In one exemplary embodiment, the novel transfer fixing device simultaneously transfers and fixes a toner image onto a surface of a recording medium traveling along a media conveyance path, and includes a transfer fixing member, a pressure member, and a primary heater. The transfer fixing member defines a moving surface on which the toner image travels. The pressure member is pressed against the transfer fixing member to define a transfer fixing nip where the toner image traveling along the moving surface meets the surface of the recording medium traveling along the media conveyance path. The primary heater is located upstream of the transfer fixing nip along the media conveyance path to heat the surface of the recording medium before entering the transfer fixing nip. The heated surface of the recording medium fuses toner for transfer and fixing into place at the transfer fixing nip. The pressure member is at least partially electrically biased to generate an electrostatic field to promote transfer of toner at the transfer fixing nip.

Another exemplary aspects of the present invention are put forward in view of the above-described circumstances, and provide a novel image forming apparatus incorporating a transfer fixing device.

In one exemplary embodiment, the novel image forming apparatus includes an electrophotographic imaging unit and a transfer fixing device. The electrophotographic imaging unit electrophotographically forms a toner image. The transfer fixing device simultaneously transfers and fixes a toner image onto a surface of a recording medium traveling along a media conveyance path, and includes a transfer fixing member, a pressure member, and a primary heater. The transfer fixing member defines a moving surface on which the toner image travels. The pressure member is pressed against the transfer fixing member to define a transfer fixing nip where the toner image traveling along the moving surface meets the surface of the recording medium traveling along the media conveyance path. The primary heater is located upstream of the transfer fixing nip along the media conveyance path to heat the surface of the recording medium before entering the transfer fixing nip. The heated surface of the recording medium fuses toner for transfer and fixing into place at the transfer fixing nip. The pressure member is at least partially electrically biased to generate an electrostatic field to promote transfer of toner at the transfer fixing nip.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
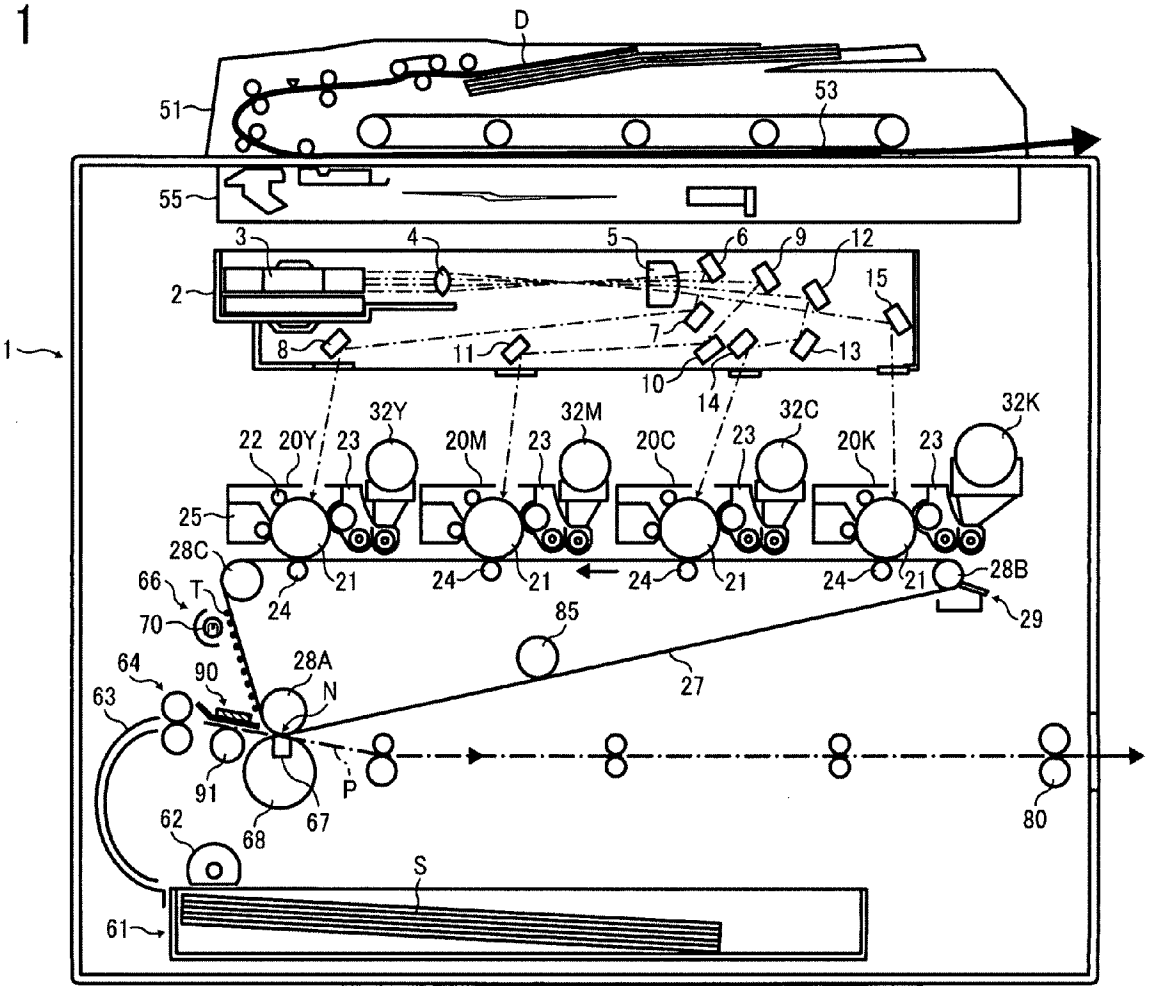
FIG. 1 schematically illustrates an image forming apparatus incorporating a transfer fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 according to one embodiment of this patent specification.

As shown in FIG. 1, the image forming apparatus 1 is a tandem color printer including four imaging stations 20Y, 20M, 20C, and 20K arranged in series below a write scanner 2 around center of the apparatus body, as well as a document conveyer 51 and a document scanner 55 provided atop the apparatus body. The image forming apparatus 1 also includes a conveyance roller 62, a sheet guide 63, a pair of registration rollers 64, and a pair of ejection rollers 80 together defining a sheet conveyance path P, along which a recording medium S, such as a sheet of paper, travels from a sheet supply tray 61 holding a stack of recording sheets S at the bottom of the apparatus body.

In the image forming apparatus 1, each imaging unit (indicated collectively by the reference numeral 20) has a drum-shaped photoconductor 21 surrounded by a charging device 22, a development device 23, an electrically biased, primary transfer roller 24, a cleaning device 25, a discharging device, not shown, etc., working in cooperation to electrophotographically form an image T with toner particles of a particular primary color, as designated by the suffix letters, "Y" for yellow, "M" for magenta, "C" for cyan, and "K" for black.

The imaging units 20Y, 20M, 20C, and 20K are provided with replaceable toner bottles 32Y, 32M, 32C, and 32K for supplying toner to the respective development device 23. The imaging unit 20 may have the photoconductive drum 21, the charging device 22 and the cleaning device 25 integrated into a single removable unit for replaceable installation in the image forming apparatus 1.

According to this patent specification, the image forming apparatus 1 incorporates a simultaneous transfer fixing or "trans-fixing" device 66 that simultaneously transfers and fixes a toner image T formed by the electrophotographic imaging units 20 into place on a recording sheet S fed through the sheet conveyance path P.

Figure 2:
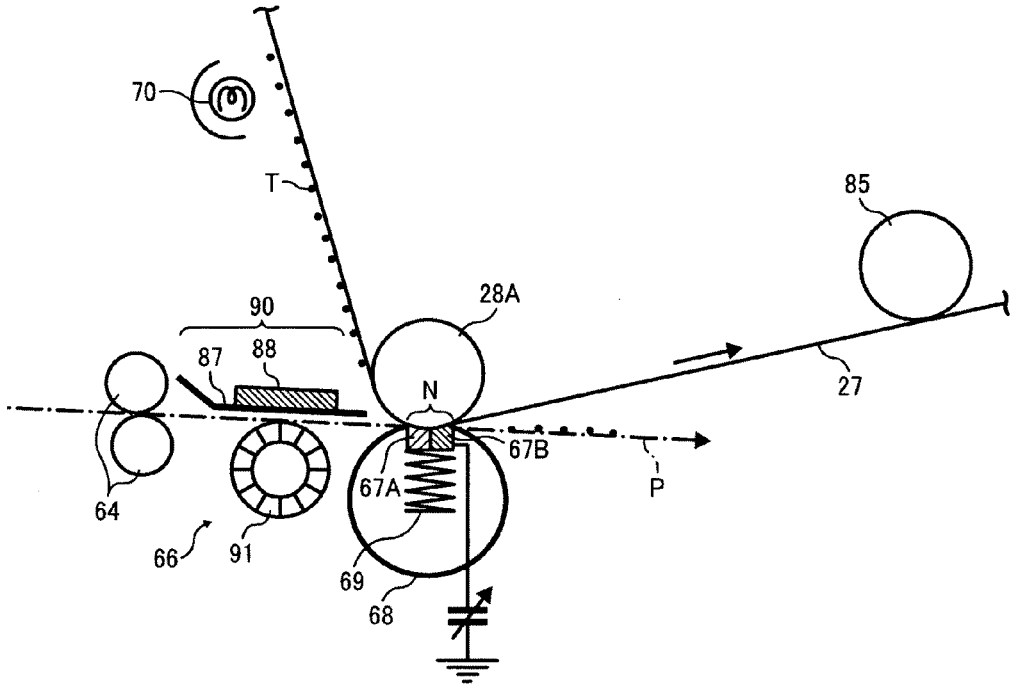
FIG. 2 schematically illustrates one embodiment of the transfer fixing device according to this patent specification.

With additional reference to FIG. 2, the trans-fixing device 66 includes a trans-fixing belt 27 entrained around multiple rollers 28A through 28C for rotation along an endless travel path counterclockwise in the drawing, a spring-loaded pressure member 67 pressed against the trans-fixing belt 27 through a looped release belt 68 to form a contact area or trans-fixing nip N between the trans-fixing belt 27 and the release belt 68 where the toner image T traveling on the rotating belt 27 meets the recording sheet S traveling along the sheet conveyance path P during simultaneous transfer and fixing. Also, the trans-fixing device 66 includes a belt heater 70 located adjacent to the trans-fixing belt 27 upstream from the trans-fixing nip N along the sheet conveyance path, a belt cooling roller 85 held in contact with the trans-fixing belt 27 downstream from the trans-fixing nip N, and a sheet heater 90 and a brush pressure roller 91 located immediately upstream of the trans-fixing nip N along the sheet conveyance path P.

To print a color image with the image forming apparatus 1, a user initially places an original document D in position on the document conveyer 51 for automatically conveying it face down onto a contact glass 53, through which the document scanner 55 scans the bottom face of the original D with a lamp emitting light.

In the document scanner 55, the scanning light reflected off the document surface passes through a series of mirrors and lenses to converge at the surface of a color sensor, not shown, which divides the incoming light into red, green, blue (RGB) color components, and converts the respective colors into electrical signals for processing by a digital image processor, not shown. The image processor then performs a series of computation, such as color conversion, color correction, spatial frequency analysis, etc. on the incoming signals to obtain image data for the respective primary colors (i.e., yellow, magenta, cyan, and black) for output to the write scanner 2.

In the write scanner 2, a laser source, not shown, emits laser beams modulated according to the image data, which reflect off facets of a polygon mirror 3 to go through lenses 4 and 5, and subsequently pass along separate light paths defined by different sets of reflection mirrors to enter the different imaging units 20. Specifically, mirrors 6, 7, and 8 reflect a laser beam representing an yellow component of the image data sequentially for forwarding it into the yellow imaging unit 20Y. Likewise, mirrors 9, 10, and 11 forward a laser beam representing a magenta component into the magenta imaging unit 20M, mirrors 12, 13, and 14 forward a laser beam representing a cyan component into the cyan imaging unit 20C, and a mirror 15 forwards a laser beam representing a black component into the black imaging unit 20K.

In each imaging unit 20, the photoconductor drum 21 clockwise in the drawing to forward its outer, photoconductive surface to a series of electrophotographic processes, including charging, exposure, development, transfer, and cleaning.

First, the photoconductive surface is uniformly charged by the charging device 22 and subsequently exposed to the modulated laser beam emitted from the write scanner 3. The laser exposure selectively dissipates the charge on the photoconductive surface to form an electrostatic latent image thereon according to image data representing a particular primary color. Then, the latent image enters the development device 23 which renders the incoming image into visible form using toner. The toner image thus obtained is forwarded to a primary transfer nip where the trans-fixing belt 27 passes between the photoconductive drum 21 and the primary transfer roller 24.

At the primary transfer nip, the primary transfer roller 24 applies a bias voltage of a polarity opposite that of toner to the trans-fixing belt 27. This electrostatically transfers the toner image from the photoconductive surface to the outer surface of the belt 27, with a certain small amount of residual toner particles left on the photoconductive surface. After primary transfer, the photoconductive surface enters the cleaning device 25 to clean off residual toner, and then to the discharging device to remove residual charges for completion of one imaging cycle.

In coordination with the imaging units 20 forming primary toner images of different colors, the trans-fixing belt 27 travels along its endless travel path to initially pass through the four primary transfer nips, then heated by the belt heater 70 to pass through the trans-fixing nip N, and then finally cooled by the cooling roller 85 and cleaned by a belt cleaner 29.

First, the trans-fixing belt 27 sequentially receives four toner images at the primary transfer nips, which are superimposed one atop another to form a multicolor toner image T on the traveling belt surface. The belt 27 then advances adjacent to the belt heater 70, which heats the toner image T and the belt surface to a certain moderate temperature considerably lower than that experienced by a thermal belt heated to fuse toner thereon in a conventional configuration. After heating, the belt 27 forwards the toner image T into the trans-fixing nip N between the roller 28A and the pressure member 67.

At the same time, the conveyance roller 62 conveys a recording sheet S from the sheet tray 61 along the sheet guide 63 toward the pair of registration rollers 64 in the sheet conveyance path P. The registration rollers 64 hold the incoming sheet S therebetween, and then advance it in sync with the movement of the trans-fixing belt 27 to between the sheet heater 90 and the brush pressure roller 91. The registration rollers 64 are responsible for forwarding the recording sheet S into the trans-fixing nip N between the sheet heater 90 and the brush pressure roller 91 where the distance between the registration and the trans-fixing nip N is shorter than the minimum length of recording sheet that can be accommodated in the image forming apparatus 1.

During travel from the registration toward the trans-fixing nip N, the recording sheet S has its upper surface in contact with the sheet heater 90 as the pressure roller 91 applies gentle upward pressure. The sheet heater 90 heats the surface of the recording sheet S to a sufficiently high temperature, preferably higher than that of the preheated surface of the trans-fixing belt 27. Immediately after heating, the recording sheet S enters the trans-fixing nip N between the sheet heater 90 and the brush pressure roller 91.

At the trans-fixing nip N, the trans-fixing device 66 simultaneously transfers and fixes the incoming toner, image T onto the fed recording sheet S through a thermal process, where toner particles, molten with heat emanating from both the sheet surface and the belt surface, turn into a viscoelastic mass that readily adheres to the sheet surface for settling thereon under pressure. Such simultaneous transfer and fixing can take place not only thermally but also electrostatically in the trans-fixing device 66 according to this patent specification, where the pressure member 67 is at least partially electrically biased to create an electrostatic bias field to promote transfer of toner to the recording sheet S.

After exiting the trans-fixing nip N, the trans-fixing belt 27 meets the belt cooling roller 85 to remove residual heat, and then enters the belt cleaner 29 to clean off residual toner and other residues to complete one cycle of rotation along the belt travel path. The recording sheet S bearing the finalized image is ejected by the output rollers 80 to outside to complete one operational cycle of the image forming apparatus 1. Throughout such printing operation, the image forming apparatus 1 coordinates performance of various imaging processes with a linear velocity of approximately 300 mm/sec. at which the recording sheet S travels along the sheet conveyance path P.

Although not depicted in the drawing, the image forming apparatus 1 may have an image analyzer and an additional, retractable belt cleaner located adjacent to the trans-fixing belt 27 downstream of the yellow imaging unit 20Y and upstream of the trans-fixing nip N along the belt travel path. Such arrangement allows the image forming apparatus 1 to adjust individual primary toner images in terms of densities and in positions relative to each other according to results of analyzing a test pattern deposited on the belt 27 which is removed subsequent to analysis without entering the trans-fixing nip N.

Preferably, the image forming apparatus 1 incorporating the trans-fixing device 66 according to this patent specification employs electrophotographic toner of a type suitable for fusing at relatively low temperatures, for example, with a softening point of approximately 100° C.

Examples of binder resins used to prepare toner with low fusing temperature include polymers of styrenes or substituted styrenes such as polyester, polystyrene, poly-p-chlorostyrene, polyvinyl toluene, and the like; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-acrylonitrile-indene copolymer, a styrene-maleic acid copolymer and a styrene-maleic acid ester copolymer.

Optionally, the following resins may be used in combination with the binder resins: polymethyl methacrylate, polybutyl methacrylate, polyvinyl chloride, polyvinyl acetate, polyethylene, polypropylene, polyurethane, polyamide, epoxy resins, polyvinyl butyral, polyacrylic resins, rosins, modified rosins, terpene resins, phenol resins, aliphatic or alicyclic hydrocarbon resins, aromatic petroleum resins, chlorinated paraffin and paraffin wax. Among these, polyester resins, and particularly crystalline polyester resins are preferable for obtaining sufficient fusing, which readily melt and soften with heat to firmly adhere to the recording medium to provide prints with excellent color fidelity.

Examples of alcohols used to prepare a polyester resin through condensation polymerization of alcohol and carboxylic acid include diols such as polyethylene glycol, diethylene glycol, triethylene glycol, 1,2-propylene glycol, 1,3-propylene glycol, 1,4-butanediol, neopentyl glycol and 1,4-butenediol, 1,4-bis (hydroxymethyl) cyclohexane, bisphenol A, hydrogen-added bisphenol A, etherificated bisphenols such as polyoxyethylene bisphenol A and polyoxypropylene bisphenol A, bivalent alcohols obtained by substituting the above compounds with a saturated or unsaturated hydrocarbon groups having 3 to 22 carbon atoms and other bivalent alcohols.

Examples of carboxylic acids used to prepare a polyester resin through condensation polymerization of alcohol and carboxylic acid include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, bivalent organic acid monomers obtained by substituting thereof with a saturated or unsaturated hydrocarbon group having 3 to 22 carbon atoms, acid anhydride is thereof, dimer of lower alkylester and linolenic acid and other bivalent organic acid monomers.

Polyester resins for use as binder resins may also be prepared with polymers of polyfunctional monomers with tri- or higher functionalies, instead of those with bifunctionality, such as tri- or higher-functional alcohol monomers or carboxylic acid monomors. Examples of polyvalent alcohol monomers include sorbitol, 1,2,3,6-hexanetetrol, 1,4-sorbitan, pentaerythritol, dipentaerythritol, tripentaerythritol, sucrose, 1,2,4-butantriol, 1,2,5-pentantriol, glycerol, 2-methylpropanetriol, 2-methyl-1,2,4-butantriol, trimethyrolethane, trimethyrolpropane and 1,3,5-trihydroxymethylbenzene.

Examples of polyvalent carboxylic acid monomers include 1,2,4-benzenetricarboxylic acid, 1,2,5-benzentricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl) methane, 1,2,7,8-octanetetracarboxylic acid, enpol trimeric acid and anhydrides thereof.

Toner used with the trans-fixing device 66 according to this patent specification may contain any release agent known in the art to effect good release of toner from the trans-fixing belt 27. For example, unesterified fatty acid-free carnauba wax, montan wax, oxidized rice wax, and ester wax may be used alone or in combination. The carnauba wax may have a microcrystal structure, an acid value of not greater than about 5 mgKOH/g, and a particle diameter of not greater than about 1 μm when dispersed in a toner binder. The montan wax generally refers to a purified mineral wax, and also may have a microcrystal structure and an acid value ranging from about 5 mgKOH/g to about 14 mgKOH/g. The oxidized rice wax is obtained by oxidizing a rice bran wax with air, and may have an acid value ranging from about 10 mgKOH/g to about 30 mgKOH/g. When each of the acid values of the above waxes does not reach the above range, a temperature of toner fixation increases, causing insufficient low temperature fixation. On the contrary, when each of the acid values exceeds the above range, a cold offset temperature increases, also causing insufficient low temperature fixation.

An amount of wax added to the binder resin may be in a range of from about 1 to about 15, and preferably, in a range from about 3 to about 10 per 100 parts by weight of the binder resin. Adding wax in amounts less than 1 part by weight effects little releasing of toner, whereas adding wax in amounts exceeding 15 parts by weight causes undesirable adhesion of toner particles to carrier granules.

Other additives may also be used to improve toner fluidity, such as silica, titanium oxide, alumina, and/or the like. If necessary, fatty acid metallic salts, polyvinylidene fluoride, and/or the like, may be added as well. The trans-fixing device 66 according to this patent specification with its good heating capability allows use of toner with relatively large amounts of these additives, for example, large silica particles on the order of several submicrons, which provides improved fluidity and transfer performance without compromising fixing at relatively low temperatures.

Referring now to FIG. 2, which schematically illustrates one embodiment of the trans-fixing device 66 according to this patent specification, there is shown the trans-fixing device 66 with the trans-fixing belt 27 supported on the roller 28A, the spring-loaded pressure member 67 with the release belt 68 looped therearound, the sheet heater 90 located downstream of the registration rollers 64 and upstream of the trans-fixing nip N along the sheet conveyance path P.

In the present embodiment, the trans-fixing belt 27 comprises a multi-layered endless belt formed of a substrate covered with an intermediate layer of elastic material and an outer layer of release agent, for example, a triple-layered belt approximately 300 mm wide and approximately 1,150 mm long, consisting of a substrate of polyimide resin approximately 80 μm thick, an intermediate layer of silicone rubber approximately 200 μm thick, and an outer layer of fluorocarbon resin or rubber approximately 7 μm thick. The release agent layer effects good stripping of toner from the outer surface of the belt 27, and the elastic layer allows the belt surface to substantially conform to the surface of a recording sheet S under pressure.

The sheet heater 90 comprises a thermally conductive guide plate 87 with a heating element 88 bonded thereon to generate heat for conduction through the plate 87, as well as a thermometer, not shown, for detecting temperature of the heated plate 87.

Specifically, the guide plate 87 is a plate of thermally conductive material, such as copper or aluminum, approximately 0.2 mm in thickness, extending along the sheet conveyance path P downstream of the registration rollers 64 and immediately upstream of the trans-fixing nip N. The guide plate 87 is dimensioned sufficiently long along the sheet conveyance path P and positioned with its downstream end sufficiently close to the trans-fixing nip N.

The guide plate 87 defines a substantially planar guide surface at the bottom coated with nickel plating containing fluorocarbon polymer particles dispersed therein, for example 30% by volume of polytetrafluoroethylene (PTFE) dispersion, for protection and durability purposes. Compared to a conventional plastic coating, the PTFE-impregnated nickel plating is superior in terms of slickness, wear resistance, and releasability, and in particular, exhibits a significant hardness as deposited of approximately HV 300, thus effectively preventing toner or paper powder from building up on the surface to ensure high durability of the guide plate 87. Other wear-resistant materials, such as diamond-like carbon (DLC) or graphite-like carbon (GLC), may also be used as a protective coating on the guide plate 87.

The heating element 88 may be any electric heater with a positive temperature coefficient (PTC) of resistance, which becomes extremely resistant to regulate its temperature when heated above a specific threshold called the Curie point. The heating element 88 is attached to a surface of the guide plate 87 opposite the planar guide surface, so as to heat the guide plate 87 to a temperature ranging from approximately 140° C. to approximately 200° C. during operation. The PTC heating element 88 with self-regulating property prevents overheating of the guide plate 87, and such PTC heater bonded to a relatively less expensive metal plate allows for thermally-efficient and cost-effective configuration of the sheet heater 90.

During operation, the sheet heater 90 heats one side (in the present case, the upper surface) of the recording sheet S that is guided along the bottom surface of the guide plate 87 and will receive a toner image T upon entering the trans-fixing nip N. As the sheet S and the toner image T enter the trans-fixing nip N, heat emanating from the heated surface of the recording sheet S fuses toner particles in contact therewith, thereby effecting thermal transfer and fixing of the toner image T onto the recording sheet S.

In such a configuration, as the guide plate 87 extends sufficiently long along the sheet conveyance path P and has its downstream end sufficiently close to the trans-fixing nip N, the sheet S can receive as much heat as possible from the sheet heater 90 while losing as little heat as possible from its heated surface before entering the trans-fixing nip N to undergo trans-fixing process. Thus, the sheet S can undergo the trans-fixing process before the heat applied to the upper surface dissipates into the atmosphere, or otherwise flows toward the side opposite the heated surface, leading to heating with high thermal efficiency.

The efficacy of the closeness between heating and trans-fixing processes can be appreciated from the fact that even a distance of travel of several millimeters in the atmosphere causes a heated surface to lose a significant amount of heat through dissipation. According to results of experiments conducted under simulated conditions, a paper sheet weighing 300 grams per square meter, heated to approximately 140° C. through a 60-msec contact with a 1-mm thick copper plate at 160° C., experienced a significant temperature drop of approximately 30° C. during travel through the atmosphere at 40° C. for 10 msec. (equivalent to a 3-mm travel at a velocity of 300 mm/sec.).

High thermal efficiency of the sheet heater 90 not only provides a reduction in overall energy consumption in the image forming apparatus 1, but also eliminates the need for heating the recording sheet S deeply and thoroughly prior to trans-fixing process, which would otherwise result in excessive adhesion of toner to the overheated sheet surface and concomitant failures during transfer and/or fixing.

Moreover, fusing toner on the preheated surface of a recording sheet S allows the trans-fixing belt 27 to operate at relatively low temperatures, which leads to reduced thermal stress and increased durability of the trans-fixing belt 27. Furthermore, preheating the recording sheet S separate from the trans-fixing belt 27 enables control of temperature for thermal fixing at the trans-fixing nip N depending on the type of recording media in use. This leads to trans-fixing at relatively low temperature ranges, which in turn reduces warm-up time and energy consumption in the image forming apparatus 1 incorporating the trans-fixing device 66.

For further increasing thermal efficiency in preheating recording sheets S, the trans-fixing device 66 may have the brush pressure roller 91 opposite the sheet heater 90.

The brush pressure roller 91 comprises a roller having an outer surface covered with heat-resistant fibrous or porous material, for example, a roller formed by spirally winding a strip of polyimide bristles around a cylindrical metal core. Other possible configurations include rollers covered with polyurethane foam or felt, and plates covered with bristles, foam, felt, or other suitable covering of heat-resistant material.

The roller 91 is rotatably held against the guide plate 87 over a length approximately 3 mm to approximately 12 mm along the sheet conveyance path P, to press the recording sheet S against the heated guide plate 87 while rotating clockwise in the drawing as the sheet S advances to the trans-fixing nip N. This maintains the fed sheet S in consistent and extended contact with the guide plate 87, which ensures that the sheet heater 90 heats the sheet S to a desired temperature to prevent fixing failure due to insufficient preheating.

Providing the pressure roller 91 with a heat-resistant, fibrous outer covering allows the roller 91 to work properly over time in contact with the heated plate 87 without thermally induced failures. Since the fibrous surface can establish point or line contact rather than surface contact with an adjacent surface, the pressure roller 91 has an extremely low area of contact with the recording sheet S. This prevents the roller 91 from absorbing excessive amounts of heat from the recording sheet S to cause significant heat loss, and from interfering with movement of the sheet S as it travels along the sheet conveyance path P.

Further, in addition to the sheet heater 90, the trans-fixing device 66 may have the belt heater 70 and the belt cooing roller 85 as heating equipment provided on the trans-fixing belt 27. It is to be noted, however, that the trans-fixing device 66 performs thermal transfer with heat resulting primarily from preheating with the sheet heater 90, and provision of the belt heater 70 is rather optional when such sheet heating yields sufficient heat for fusing toner on the recording sheet S at the trans-fixing nip N.

The belt heater 70 comprises any suitable heating device, for example, a radiation heater such as a halogen heater or a carbon heater. The belt heater 70 is located adjacent to the trans-fixing belt 27 upstream of the trans-fixing nip N and downstream of the primary transfer nips so as to heat the toner image T prior to entering the trans-fixing nip N. Although the heater 70 faces the outer surface of the belt 27 in the several embodiments depicted herein, alternatively, it is also possible that the heater 70 face the inner surface of the belt 27 to preheat the toner image T from within the loop of the belt travel path.

The belt cooling roller 85 comprises any suitable cooling device, for example, a heat pipe that can quickly transfer heat from one surface for dissipation to another surface. The belt cooling roller 85 is held against the trans-fixing belt 27 downstream from the trans-fixing nip N along the belt travel path, so as to absorb heat from the belt surface and distribute it uniformly across the width of the belt 27 through internal convection.

Providing the cooling roller 85 downstream from the trans-fixing nip N is desirable where the sheet heater 90 heats the recording sheet S to a temperature hotter than that of the trans-fixing belt 27. At the trans-fixing nip N, the heated sheet S imparts higher and lower amounts of heat to different portions of the belt 27, resulting in uneven distribution of heat over the belt surface exiting the trans-fixing nip N and concomitant transfer failure or inconsistent fixing. The cooling roller 85 downstream from the trans-fixing nip N prevents such trans-fixing defects by removing excessive heat from the belt surface and maintaining uniform distribution of heat over the belt surface.

Figure 3:
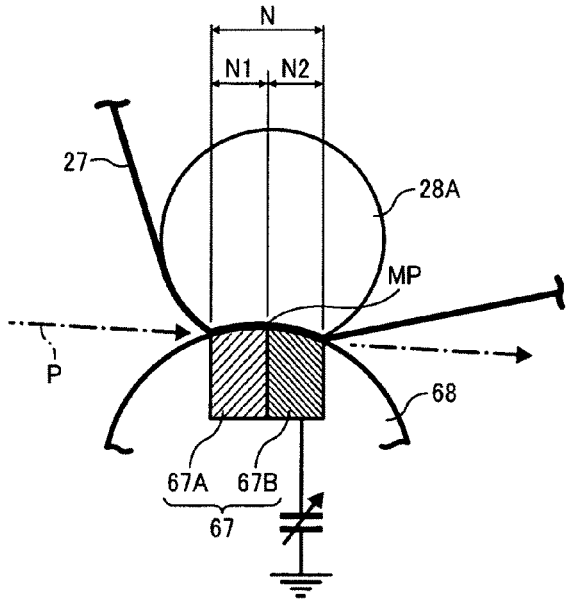
FIG. 3 is an enlarged view of a transfer fixing nip included in the transfer fixing device of FIG. 2.

With additional reference to FIG. 3, which is an enlarged view of the trans-fixing nip N, the pressure member 67 comprises a substantially non-conductive, first pressure pad 67A and a substantially conductive, second pressure pad 67B adjoining each other, both pressed against the outer surface of the trans-fixing belt 27 with the spring 68 through the looped release belt 68 to define the trans-fixing nip N extending approximately 10 to 15 mm along the sheet conveyance path P.

Specifically, the release belt 68 comprises a seamless belt of suitable material such as polyimide with an outer surface coated with a release agent. Held in frictional contact with the transfer-fixing belt 27, the release belt 68 rotates around the pressure member 67 clockwise in FIGs. as the transfer-fixing belt 27 rotates along the belt travel path, which effects stripping of recording sheets P passing through the trans-fixing nip N. The interface between the release belt 68 and the pressure member 67 is provided with a lubricating agent, such as silicone oil or fluorine-based grease, for reducing friction or drug during movement of the release belt 68 relative to the pressure member 67.

The first pressure pad 67A is made of an insulating or semi-insulating material in the form of rubber or sponge, extending along the axial length of the roller 28A to define a first area N1 of contact between the belts 27 and 68 at an upstream end of the trans-fixing nip N. The second pressure pad 67B is made of a conductive material, such as stainless steel, extending along the axial length of the roller 28A to define a second area N2 of contact between the belts 27 and 68 at a downstream end of the trans-fixing nip N.

The first and second pressure pads 67A and 67B are electrically isolated from each other, and only the second pressure pad 67B is supplied with an electrical bias to develop an electrostatic transfer field in the second area N2 to promote transfer of toner from the trans-fixing belt 27 toward the recording sheet S within the trans-fixing nip N. The first and second pads 67A and 67B have substantially symmetrical cross-sections which together form a convex shape engaging the roller 28A, so that pressure across the trans-fixing nip N is at a maximum along a zone MP (hereinafter "maximum pressure zone") defined between the adjoining edges of the first and second pads 67A and 67B, which extends in the direction in which FIG. is drawn.

In such a configuration, the pressure member 67 is selectively electrically biased in the second area N2 downstream of the maximum pressure zone MP where pressure against the transfer fixing belt 27 is at a maximum across the transfer fixing nip N, and not in the first area N1 upstream of the maximum pressure zone MP. As will be described later, the pressure member 67 may be configured in a manner different from that depicted in the present embodiment, upon which depend the locations of maximum pressure zone and transfer field.

During operation, the pressure member 67 exerts appropriate pressure against the trans-fixing belt 27 which holds a recording sheet S against the trans-fixing belt 27 entering the trans-fixing nip N. Throughout the trans-fixing nip N, the trans-fixing device 66 performs simultaneous transfer and fixing through the thermal process which fuses toner with heat derived from preheating with the belt heater 70 and the sheet heater 90, as described above.

Moreover, in the second area N2 of the trans-fixing nip N, the trans-fixing device 66 can perform simultaneous transfer and fixing through an electrostatic process, where the second pressure pad 67B is electrically biased to generate a transfer field that drives remaining toner from the trans-fixing belt 27 to the recording sheet S, followed by fusing the toner on the sheet surface that still retains sufficient heat resulting from preheating.

In general, thermally-assisted transfer (or trans-fixing) is superior to electrostatic transfer separate from thermal fixing in terms of toner transfer efficiency and resulting image resolution, since it can render toner particles into a viscoelastic mass during transfer, which readily adheres to desired portions of a recording sheet even across minute gaps present between paper and transfer member surfaces. Using an elastic trans-fixing member that can conform to microscopic irregularities further improves efficacy of the trans-fixing process, so that it can accommodate printing with relatively rough recording sheets.

However, this is no longer the case where the irregularities of a recording sheet are extremely large, such as on the order of approximately 30 pm or more, to which even the elastic trans-fixing member cannot fully conform.

Figure 4:
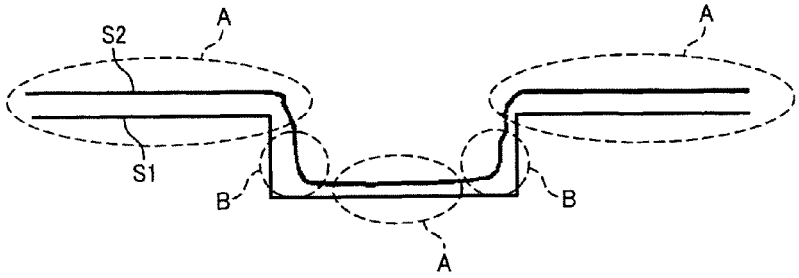
FIG. 4 is an enlarged view schematically illustrating the interface between an extremely rough surface of recording sheet and a surface of transfer fixing member pressed together in a transfer fixing nip.

FIG. 4 is an enlarged view schematically illustrating the interface between an extremely rough surface of recording sheet S1 and a surface of trans-fixing member S2 pressed together in a trans-fixing nip.

As shown in FIG. 4, with nip pressure being applied normal to the direction in which the interface surfaces S1 and S2 extend, the two surfaces S1 and S2 establish relatively tight contact at portions "A" where the sheet surface S1 is in horizontal planes perpendicular to the nip pressure, and relatively loose contact at portions "B" where the sheet surface S1 is dented or bent away from the horizontal plane. Such variation in contact pressure translates into variation in transfer rate at which toner particles are transferred from the belt surface to the sheet surface, resulting in certain amount of toner failing to transfer to the sheet surface at the areas of loose contact B.

As mentioned, the trans-fixing device 66 according to this patent specification can perform transfer and fixing primarily with heat at the first area N1, and secondarily with electrostatic transfer field as well as with heat at the second area N2 within the trans-fixing nip N.

Thus, should a small amount of toner fail to thermally transfer in the first area N1, such residual toner is eventually transferred electrostatically in the second area N2. Such combination of thermal and electrostatic transfer capabilities enables printing on an extremely rough surface with excellent image density as well as consistent image resolution, as the primary thermal transfer works where the trans-fixing belt 27 tightly contacts the rough surface, and the secondary electrostatic transfer works where the trans-fixing belt 27 loosely contacts the rough surface.

Moreover, the trans-fixing device 66 can perform electrostatic transfer with extremely high transfer efficiency compared to a conventional electrostatic transfer process. This is because the secondary electrostatic transfer takes place downstream of the maximum pressure zone MP where the recording sheet S undergoes a nearly maximum, or preferably maximum, nip pressure to leave little if any gap between the sheet S and the trans-fixing belt 27, preventing toner particles from getting to undesired portions of the resulting print.

Thus, the trans-fixing device 66 according to this patent specification can provide printing with high thermal efficiency and excellent image quality, while allowing a wide range of recording media, including media have extremely rough surfaces, to be accommodated in the image forming apparatus incorporating the trans-fixing process.

Preferably, the trans-fixing device 66 according to this patent specification generates an electrostatic transfer field at the trans-fixing nip 66 with a supply voltage smaller than that required to complete an electrostatic transfer process separate from a thermal fixing process. Even with such a relatively small transfer field, the trans-fixing device 66 can properly perform electrostatic transfer that is accompanied with an efficient thermal transfer between the trans-fixing belt 27 and the recording sheet S under pressure.

Specifically, the pressure member 67 has the second pressure pad 67B electrically biased to a voltage equal to that required to yield a transfer rate of approximately 70% at which toner particles are electrostatically transferred between two unheated surfaces under pressure against each other.

Such arrangement reduces an amount of energy consumed by the trans-fixing device 66, leading to high energy efficiency of the image forming apparatus 1.

Further preferably, the trans-fixing device 66 generates a transfer field at the trans-fixing nip 66 only when the recording sheet S in use has surface irregularities or roughness to which the trans-fixing belt 27 cannot sufficiently conform.

Figure 5A:
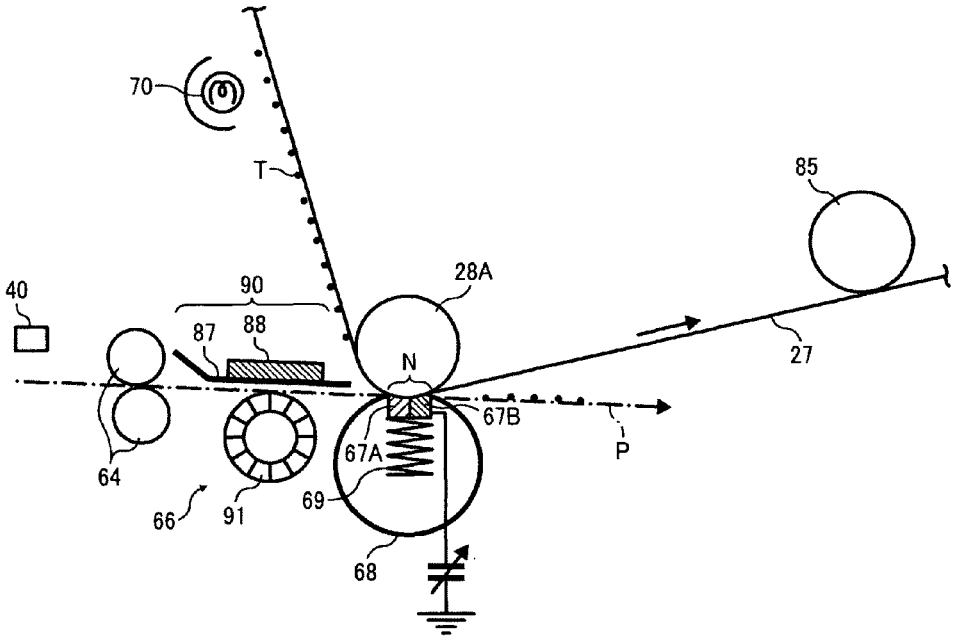
FIGS. 5A and 5B schematically illustrate arrangements of the transfer fixing device of FIG. 2.

Specifically, as shown in FIG. 5A, the trans-fixing device 66 may have a roughness meter 40 disposed upstream of the trans-fixing nip N and connected to the voltage source that supplies bias electricity to the pressure member 67. Examples of the roughness meter 40 include a non-contact optical sensor that measures light reflected off a surface to determine surface roughness, or a capacitance sensor that detects irregularities on a probed surface through capacitance variations transmitted from the probe.

The roughness meter 40 measures roughness of the surface of the recording sheet S before the recording sheet S enters the trans-fixing nip N, and signals whether the measured roughness exceeds a given upper threshold. According to this signal, the voltage source supplies the electrical bias to the pressure member 67 only when the surface roughness is so severe that the trans-fixing belt 27 does not sufficiently conform to the surface of the sheet. When the surface roughness is moderate, the trans-fixing device 66 performs simultaneous trans-fixing thermally without generating a transfer field at the trans-fixing nip N. Such arrangement pre'vents unnecessary formation of a transfer field at the trans-fixing nip N, which reduces an amount of energy consumed by the trans-fixing device 66, leading to high energy efficiency of the image forming apparatus 1.

Still further preferably, the trans-fixing device 66 varies a pressure across the trans-fixing nip N depending on whether the recording sheet S in use has a smooth surface (e.g., coated paper) to which the trans-fixing belt 27 can sufficiently conform.

Figure 5B:
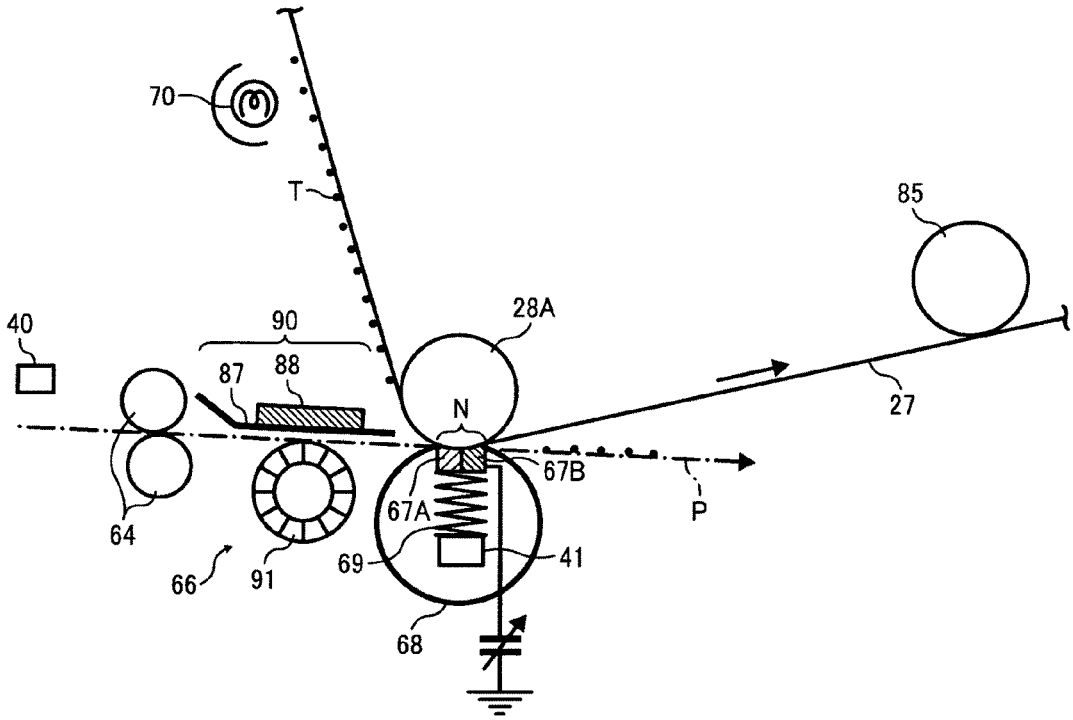

Specifically, as shown in FIG. 5B, the trans-fixing device 66 may have an actuator 41 bonded to the spring 69 pressing the pressure member 67 and connected with the roughness meter 40. According to the signal transmitted from the roughness meter 40, the actuator 41 displaces the pressure member 67 to reduce pressure against the transfer fixing belt 27 when the measured roughness falls below a given lower threshold.

Such arrangement prevents undue stress on the trans-fixing belt 27 and the release belt 68 pinched at the trans-fixing nip N without affecting imaging quality, leading to enhanced durability of the trans-fixing device 66.

According to this patent specification, the trans-fixing device 66 controls a temperature Tp to which the sheet heater 90 heats the surface of a recording sheet S before entering the trans-fixing nip N, and a temperature Tt to which the belt heater 70 heats the surface of the trans-fixing belt 27 upstream from the trans-fixing nip N (which is substantially equivalent to a temperature of a toner image T before entering the trans-fixing nip N) in relation to a fusing temperature Tfb and a softening temperature Ts of toner being used.

In this patent specification, the fusing temperature Tfb denotes a temperature at which toner melts into a fluid phase and the softening temperature Ts denotes a temperature at which toner becomes sufficiently soft (but not fused) with heat. Such thermal properties of a toner may be determined using a commercially available capillary and slit die rheometer "SHIMADZU FLOWTESTER model CFT500D" (manufactured by Shimadzu Corporation), which measures viscosity or resistance of a molten material based on a flow rate at which a sample of the melt charged and heated in a cylinder is extruded through a capillary die under constant pressure and rising temperature. For example, measurements may be carried out under the following conditions: pressure force of 5 kgf/cm$^2$; temperature rise rate of 3.0° C./min.; die diameter of 1.00 mm; and die length of 10.0 mm.

Preferably, the toner temperature Tt and the sheet temperature Tp immediately upstream of the trans-fixing nip N satisfy the following Equations 1 and 2:

$$(Tt+Tp)/2>Tfb \quad \text{Eq. 1}$$

$$Tt<Tfb \quad \text{Eq. 2}$$

Equation 1 defines a condition for preventing transfer failure due to insufficient heat at the trans-fixing nip (referred to as "cold offset"). Since cold offset occurs where toner remains insufficiently fused under low temperature during transfer process, setting a mean of the toner and sheet temperatures Tt and Tp higher than the fusing temperature Tfb prevents such transfer failure.

By contrast, Equation 2 defines a condition for preventing transfer failure caused by excessively heating the toner image T prior to transfer (referred to as "hot offset"). Hot offset occurs where toner becomes too tacky and adheres to a transfer member under high temperature during transfer. Setting the sheet temperature Tp higher than the toner or belt temperature Tt results in a viscoelastic mass of molten toner exhibiting more adhesion to the relatively hot recording sheet S than to the relatively cold trans-fixing belt 27, thereby effecting good separation of toner and preventing transfer failure.

Ready separation of toner at the trans-fixing nip allows for reduced or eliminated use of release agent or wax added, which enhances print quality in terms of color fidelity while ensuring good performance of development and charging processes. Moreover, setting the belt temperature Tt at relatively low levels facilitates cooling of the trans-fixing belt 27 downstream from the trans-fixing nip N, and prevents thermal damage to structures in contact with the heated surface of the belt 27.

Experiments were conducted to test the efficacy of the Equations 1 and 2, using a transfer fixing device with belt and sheet heaters similar to those depicted in the embodiments according to this patent specification.

In the experiments, printing was carried out on coated paper "CASABLANCA X" weighing 100 g/m$^2$ (available from OJI PAPER Co. Ltd.) using two types of electrophotographic toner with different thermal properties, one with a fusing temperature Tfb of 90° C. and the other with a fusing temperature Tfb of 110° C., with varying toner temperatures Tt and varying sheet temperatures Tp. The trans-fixing nip was conditioned so that every point of the sheet travels under a pressure of 2 kgf/cm$^2$ for 50 msec.

After each pass through the trans-fixing nip, the trans-fixing belt was visually inspected for presence of residual toner particles indicating transfer failures, followed by the obtained results categorized into five categories: "category A", indicating substantially no residual toner found on the belt after trans-fixing; "category B", indicating little amount of residual toner; "category C", indicating a moderate amount of residual toner; "category D", indicating a significant amount of residual toner; and "category E", indicating failure of toner transfer due to insufficient heat at the trans-fixing nip.

Figure 6A:
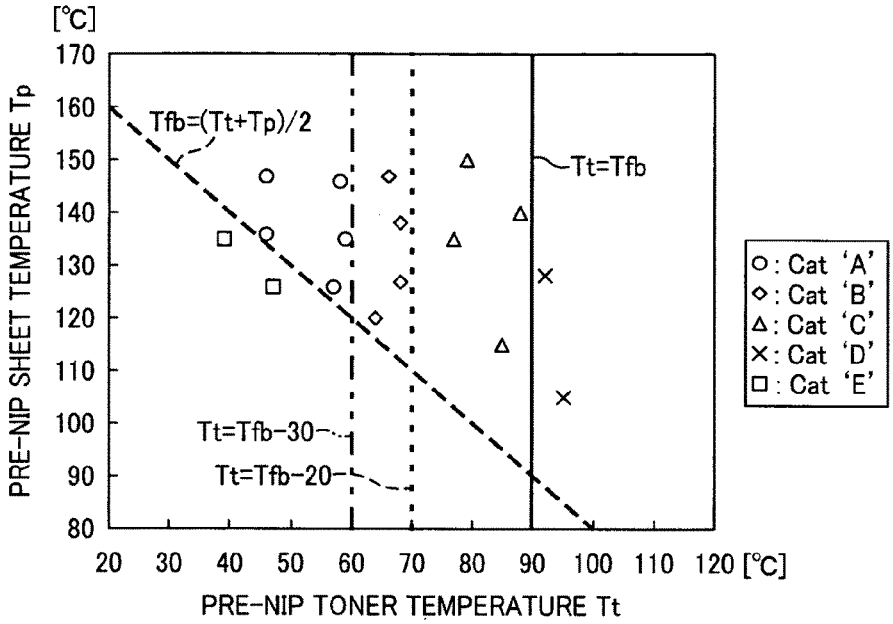
FIGS. 6A and 6B are graphs plotting results of experiments conducted to demonstrate efficacy of the transfer fixing device according to this patent specification.
Figure 6B:
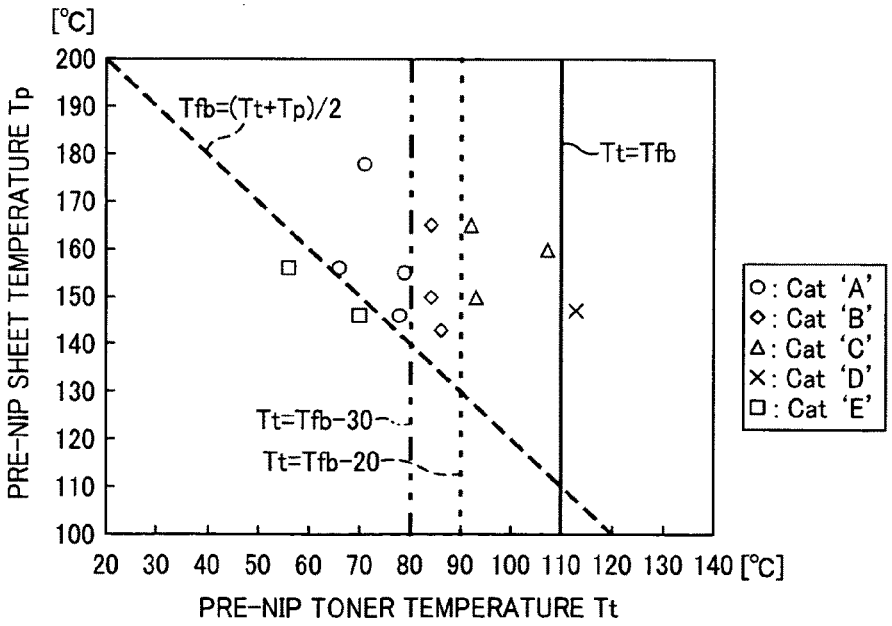

FIGS. 6A and 6B are graphs plotting the experimental results against the toner and sheet temperatures Tt and Tp, the former obtained for toner with Tfb of 90° C. and the latter for toner with Tfb of 110° C.

In these graphs, the function (Tt+Tp)/2=Tfb defines a boundary for the mean value of toner and sheet temperatures Tt and Tp. Distribution of category E indicates that preventing cold offset at the trans-fixing nip requires the mean value of Tt and Tp to be higher than the toner fusing temperature Tfb, demonstrating the validity of the Equation 1.

Further, distribution of categories A, B, and C, representing cases in which printing was carried out without substantial transfer failure, indicates that preventing hot offset requires the toner temperature Tt to be lower than the fusing temperature Tfb, demonstrating the validity of the Equation 2.

Moreover, in the present experiments, excellent transfer quality was obtained when Tfb−Tt≧20° C., and particularly when Tfb−Tt≧30° C. This implies that, with a sufficiently high sheet temperature Tp, a lower toner temperature Tt still ensures successful trans-fixing performance.

Further preferably, the trans-fixing device 66 controls a temperature Tb of the release belt 68 to fulfill the following Equation 3:

$$Tb<Ts \quad \text{Eq. 3}$$

Equation 3 defines a condition for preventing re-fusing of toner in contact with the release belt 68. Thus, satisfying Equation 3 is particularly desirable in duplex printing on two sides of a recording sheet, where one side of the sheet on which an image has been made directly contacts the release belt 68 as the other side of the sheet undergoes trans-fixing process in contact with the trans-fixing belt 27. Too high a temperature Tb of the release belt 68 would re-melt toner on the first side of the recording sheet, causing variations in image gloss between two sides of the resultant print.

Still further preferably, the toner temperature Tt and the sheet temperature Tp immediately upstream of the trans-fixing nip N satisfy both of the following Equations 4 and 5:

$$Tp>Tfb \quad \text{Eq. 4}$$

$$Tt<Ts \quad \text{Eq. 5}$$

Equation 4 defines a condition for fusing toner on the preheated surface of the recording sheet S at the trans-fixing nip N, (which is met when the Equations 1 and 2 are both satisfied). Equation 5 defines a condition for ensuring proper functioning of an electrostatic transfer field to promote transfer of toner at the trans-fixing nip N.

Figure 7:
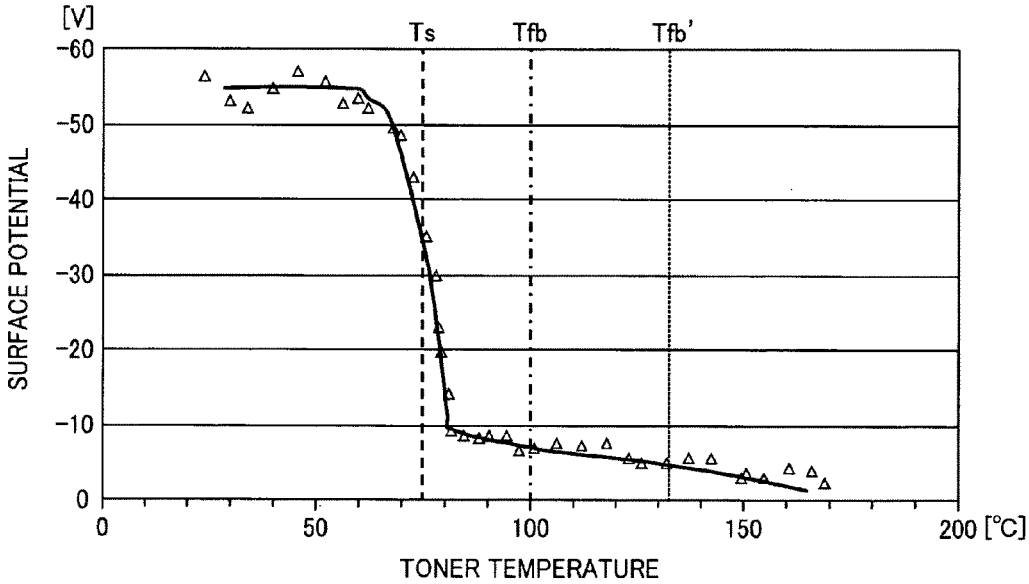
FIG. 7 is a graph plotting measurements obtained through experiments showing electrical potential of toner varying with rising temperature.

With reference to FIG. 7, which is a graph plotting measurements obtained through experiments showing electrical potential of toner varying with temperature, the toner retains most of its electrical charge at relatively low temperatures. As the temperature rises, however, it experiences a sharp and significant drop in the surface potential around the softening point Ts, and gradually loses the charge as the temperature rises to the fusing temperature Tfb and even higher to a super-fusing temperature Tfb' at which molten toner exhibits extremely high fluidity.

Considering that the electrical bias field acts on particles holding sufficient charge, it can be concluded that electrostatic transfer is effective when the toner temperature Tt does not exceed the softening temperature Ts. Accordingly, for proper functioning of the pressure member 67 generating the electrical bias field at the trans-fixing nip N, it is desirable to satisfy the Equation 5.

Note that electrostatic transfer of toner requires the toner temperature Tt to remain below the softening point Ts whereas sufficient fusing of toner requires the toner temperature Tt to rise above the fusing temperature Tfb which is higher than the softening point Ts.

The trans-fixing device 66 according to this patent specification can meet both of these seemingly mutually contradictory conditions, where the sheet heater 90 heats the recording sheet S to a relatively high temperature Tp, and the belt heater 70 heats the toner image T to a relatively low temperature Tt before the trans-fixing nip N, so that the toner temperature Tt remaining below the softening point Ts rises above the fusing temperature Tfb upon being electrostatically transferred to the sheet surface at the trans-fixing nip N.

By contrast, in a conventional trans-fixing process that heats only a trans-fixing member for thermal transfer and fixing, an attempt to adopt electrostatic transfer in addition to thermal transfer would not work since the trans-fixing member is required to be heated above the toner fusing temperature Tfb, at which temperature the toner loses most of its electrostatic charge. Thus, owing to the combination of the sheet heater 70 preheating the recording sheet S and the electrostatic transfer field generated at the trans-fixing nip N, the trans-fixing device 66 derives the benefits of high fidelity and consistent density from thermal transfer and high resolution and definition from electrostatic transfer.

In further embodiments, the trans-fixing device 66 according to this patent specification may have a pressure member, trans-fixing member, and other components in various configurations other than those primarily depicted in FIGS. 1 through 3. In all of these embodiments, the trans-fixing device can provide printing with high thermal efficiency and excellent image quality, while allowing a wide range of recording media, including extremely rough surface media, to be accommodated in the image forming apparatus incorporating the trans-fixing process, as in the embodiments depicted above.

For example, although several embodiments depicted in this patent specification use a pressure member having two adjoining symmetrical pads, one non-conductive and the other conductive and electrically biased, the pressure member may be configured in a manner different from those depicted in these embodiments, as long as the trans-fixing device 66 can bias the pressure member, preferably, downstream of where pressure across the trans-fixing nip N is maximum, for example, two symmetrical pressure pads being both conductive and electrically isolated by an insulator disposed therebetween, or three or more pads arranged along the trans-fixing nip N, only the central one(s) of which are electrically biased to generate a transfer field downstream of where pressure is at a maximum across the trans-fixing nip.

Figure 8A:
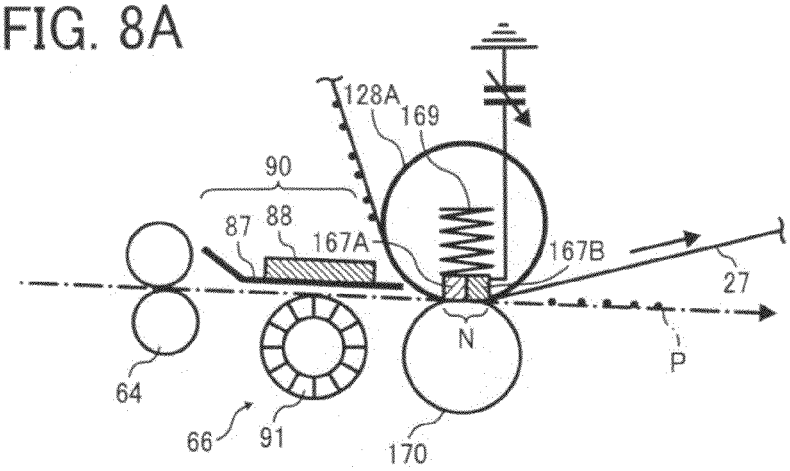
FIGS. 8A through 8C schematically illustrates several embodiments of the transfer fixing device according to this patent specification.

Moreover, as shown in FIG. 8A, the pressure member may comprise first and second pressure pads 169A and 169B with a looped belt 128A therearound and loaded with a spring 169 similar to those depicted primarily with reference to FIG. 3, except that the pressure pads 169A and 169B are disposed within the loop of the trans-fixing belt 27 and press against the inner surface of the trans-fixing belt 27 to define an area of contact or trans-fixing nip N between the trans-fixing belt 27 and a release roller 170 which comprises a cylindrical core of suitable metal such as aluminum covered with a release layer, and rotates clockwise in the drawing as the trans-fixing belt 27 rotates along the belt travel path. Other suitable structure, such as spring-loaded pads similar to the pressure pads 169A and 169B, may also be used in place of the release roller 170.

Figure 8B:
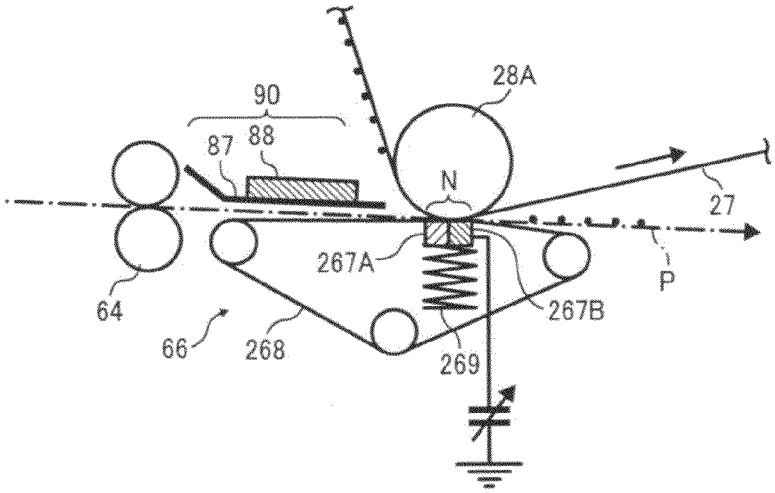

Further, as shown in FIG. 8B, the pressure member may comprise first and second pressure pads 269A and 269B pressed with a spring 269 against the outer surface of the trans-fixing belt 27 similar to those depicted primarily with reference to FIG. 3, except that the pressure pads 269A and 269B press against the belt 27 through a looped traveling belt 268 to define an area of contact or trans-fixing nip N between the trans-fixing belt 27 and the traveling belt 268. Unlike the loosely held release belt 68, the traveling belt 268 is an endless belt entrained around multiple rollers to rotate clockwise in the drawing, which serves to forward a recording sheet S from the registration rollers 64 into the trans-fixing nip N.

Figure 8C:
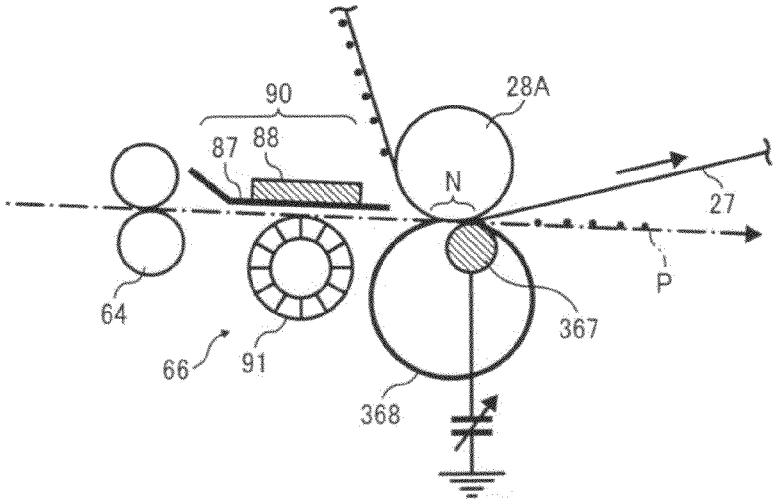

Still further, as shown in FIG. 8C, the pressure member may comprise a substantially conductive, cylindrical member 367 with a release belt 368 looped therearound, instead of the pressure pads 67A and 67B. The cylindrical member 367 is located from a center to a downstream end of an area of contact or trans-fixing nip N between the trans-fixing belt 27 and the release belt 368, and is electrically biased to generate an electrostatic transfer field to promoter toner transfer across the trans-fixing nip N. Alternatively, it is also possible to dispose an electrically biased cylindrical member within the loop of the trans-fixing belt 27, or to provide a pair of cylindrical members arranged along the trans-fixing nip N, of which only the downstream one is electrically biased.

Yet still further, the trans-fixing member may be other than that depicted in the embodiments, for example, a rotatable cylindrical body having a moving surface along which a toner image travels into a trans-fixing nip. Also, the belt cooling member may be other than the cooling roller that cools the trans-fixing member by contacting the outer surface, for example, a cooling fan located to blow air toward the outer surface of the trans-fixing belt to remove heat. Moreover, providing the belt heater is not necessary in case trans-fixing properly takes place with an amount of heat produced and applied to a recording sheet by the sheet heater along the sheet conveyance path.

In still further embodiments, the trans-fixing device 66 according to this patent specification can be arranged for incorporation in various configurations of the image forming apparatus 1 other than that depicted with reference to FIG. 1.

Figure 9:
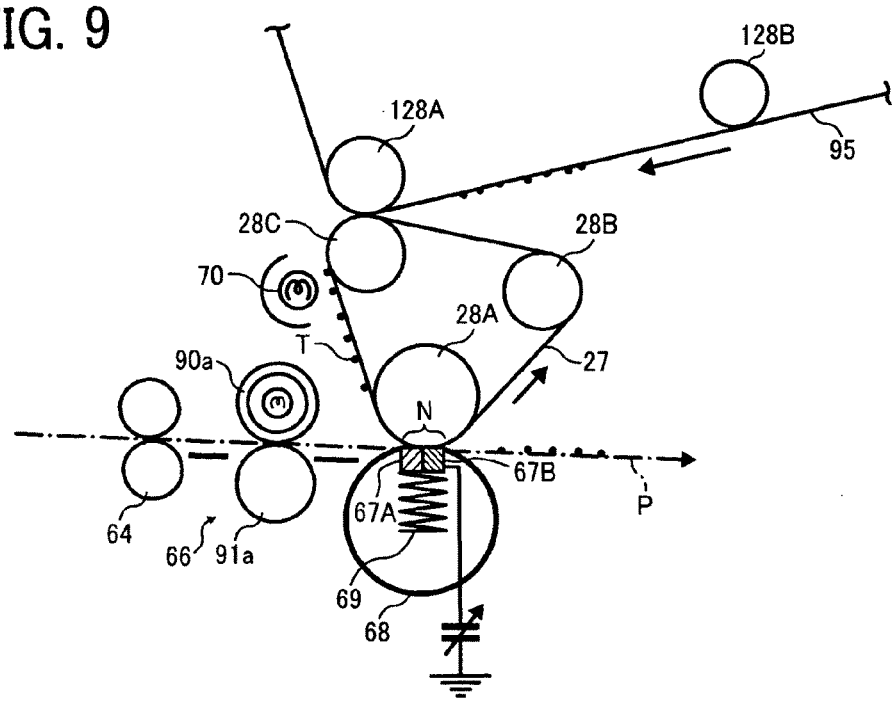
FIG. 9 schematically illustrates further embodiment of the transfer fixing device incorporated in the image forming apparatus according to this patent specification.

FIG. 9 schematically illustrates further embodiment of the trans-fixing device 66 according to this patent specification incorporated in the image forming apparatus 1 employing an additional, intermediate transfer process.

As shown in FIG. 9, the basic configuration of the present embodiment is similar to that depicted primarily in FIG. 2, except that the trans-fixing device 66 has an internally heated roller 90*a* and a pressure roller 91*a* instead of the sheet heater 90 and the brush pressure roller 91, and the image forming apparatus 1 includes an intermediate transfer belt 95 intervening between the imaging units 20 and the trans-fixing belt 27.

Specifically, the rollers 90*a* and 90*b* are pressed against each other upstream of the trans-fixing nip N along the sheet conveyance path P, and the roller 90*a* has a heater extending along its cylindrical axis to heat the roller surface from within. Although not fully depicted in FIG. 10, the intermediate transfer belt 95 is entrained around multiple rollers 128 to pass through four primary transfer nips, not shown, similar to those depicted with reference to FIG. 1.

During operation, the heated roller 90*a* and the pressure roller 91*a* rotate, the former counterclockwise and the latter clockwise in the drawing, to forward a recording sheet S from the registration rollers 64 while heating the upper surface of the sheet S prior to entering the trans-fixing nip N along the sheet conveyance path P.

The intermediate transfer belt 95 travels clockwise in the drawing to meet the trans-fixing belt 27 between the rollers 128A and 28C, where a multicolor toner image T formed through primary transfer secondarily transfers from the intermediate transfer belt 95 to the trans-fixing belt 27.

Thereafter, the trans-fixing belt 27 and the pressure member 67 operate in the manner depicted above with reference to FIG. 2 to simultaneously transfer and fix the toner image T into place on the recording sheet S entering the trans-fixing nip N.

Figure 10:
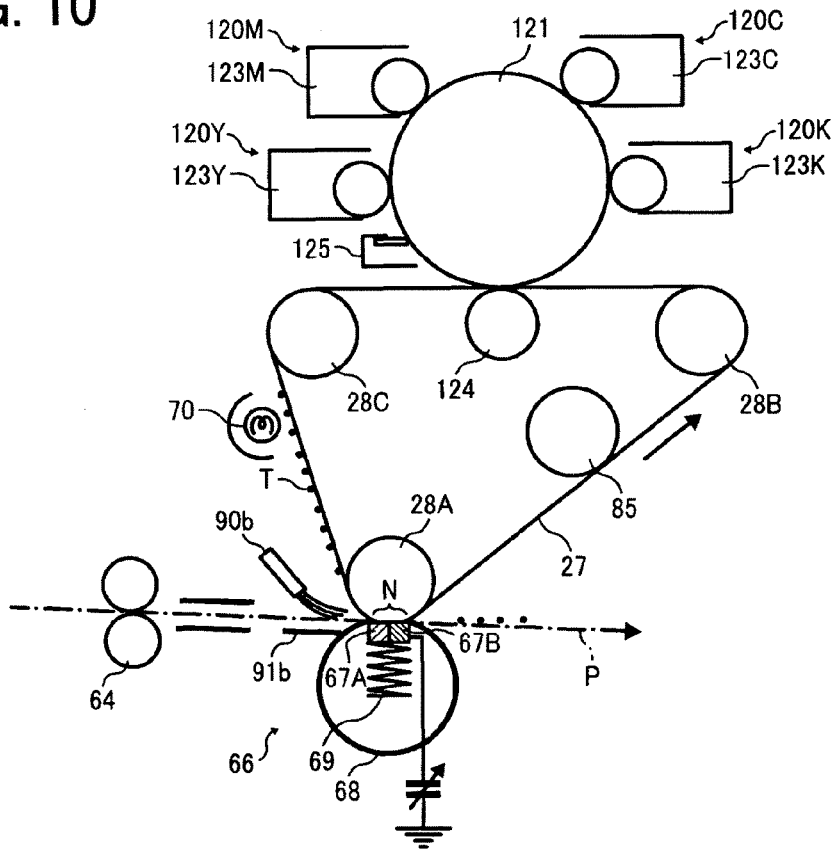
FIG. 10 schematically illustrates still further embodiment of the transfer fixing device incorporated in the image forming apparatus according to this patent specification.

FIG. 10 schematically illustrates still further embodiment of the trans-fixing device 66 incorporated in the image forming apparatus 1 employing a multi-pass imaging system.

As shown in FIG. 10, the basic configuration of the present embodiment is similar to that depicted in FIG. 2, except that the trans-fixing device 66 has a brush heater 90*b* and a pressure plate 91*b* upstream of the trans-fixing nip N along the sheet conveyance path P instead of the sheet heater 90 and the brush pressure roller 91, and the image forming apparatus 1 uses a single drum-shaped photoconductor 121 instead of the multiple photoconductive drums 21 described above with reference to FIG. 1.

Specifically, the brush heater 90*b* has brush bristles of conductive material heated by a suitable heating element, not shown, with their free ends angled toward the entrance of the trans-fixing nip N. The pressure plate 91*b* extends along the sheet conveyance path P to press against the brush heater 90*b*. Although not fully depicted in FIG. 10, the photoconductive drum 121 has its photoconductive surface surrounded by a primary transfer roller 124, a cleaning device 125 and multiple imaging stations 120Y, 120M, 120C, and 120K, each having a charging device, a development device 123, a discharging device, etc.

During operation, a recording sheet S forwarded from the registration rollers 64 passes between the brush heater 90*b* and the pressure plate 91*b*, which heats the upper surface of the sheet S prior to entering the trans-fixing nip N along the sheet conveyance path P.

The photoconductive drum 121 passes its photoconductive surface through the multiple imaging stations 120 each of which electrophotographically forms a sub-image with toner particles of a particular primary color. As the photoconductive drum 121 rotates, these sub-images are superimposed one atop another to form a multicolor toner image T on the surface of the photoconductive drum 121. After image formation, the photoconductive surface meets the trans-fixing belt 27 where the primary transfer roller 124 generates an electrostatic transfer field to transfer the toner image T from the photoconductive surface to the belt surface.

Thereafter, the trans-fixing belt 27 and the pressure member 67 operate in the manner depicted above with reference to FIG. 2 to simultaneously transfer and fix the toner image T into place on the recording sheet S entering the trans-fixing nip N.

Numerous additional modifications and variations are possible in light of the above teachings. For example, although the trans-fixing device 66 is described as being incorporated in the multicolor printer 1 as shown in FIG. 1, the trans-fixing device according to this patent specification is applicable to various types of electrophotographic image forming apparatus, such as monochrome printers, photocopiers, facsimiles, or multifunctional machines incorporating several of these imaging functions. It is therefore to be understood that, within the scope of the appended claims, the disclosure of this patent specification may be practiced otherwise than as specifically described herein.

What is claimed is:

1. A transfer fixing device that simultaneously transfers and fixes a toner image onto a surface of a recording medium traveling along a media conveyance path, the device comprising:

a transfer fixing member defining a moving surface on which the toner image travels;

a pressure member pressed against the transfer fixing member to define a transfer fixing nip where the toner image traveling along the moving surface meets the surface of the recording medium traveling along the media conveyance path;

a primary heater located upstream of the transfer fixing nip along the media conveyance path to heat the surface of the recording medium before entering the transfer fixing nip, and a roughness meter disposed along the media conveyance path upstream of the transfer fixing nip and operatively connected with the pressure member to measure roughness of the surface of the recording medium before the recording media enters the transfer fixing nip, and to cause the pressure member to generate the electrostatic field only when the measured roughness exceeds a given upper threshold, the heated surface of the recording medium fusing toner for transfer and fixing into place at the transfer fixing nip, and the pressure member being at least partially electrically biased to generate an electrostatic field to promote transfer of toner at the transfer fixing nip.

2. The transfer fixing device according to claim 1, wherein the pressure member includes:

a looped belt;

a first pad pressed against the transfer fixing member through the looped belt at an upstream end of the transfer fixing nip; and a second pad pressed against the transfer fixing member through the looped belt at a downstream end of the transfer fixing nip, the second pad being electrically isolated from the first pad and electrically biased to generate an electrostatic field to promote transfer of toner at the transfer fixing nip.

3. The transfer fixing device according to claim 2, wherein the first pad is made of an insulating or semi-insulating material in a form of rubber or sponge.

4. The transfer fixing device according to claim 2, wherein the second pad is made of steel.

5. The transfer fixing device according to claim 2, wherein the first pad and the second pad have substantially symmetrical cross-sections which together form a convex shape.

6. The transfer fixing device according to claim 2, wherein the second pad is electrically biased to generate a transfer field that drives remaining toner from a trans-fixing belt to the recording medium, followed by fusing the toner on the recording medium while retainig sufficient heat resulting from preheating.

7. The transfer fixing device according to claim 1, wherein the pressure member is selectively electrically biased downstream from where pressure against the transfer fixing member is at a maximum across the transfer fixing nip.

8. The transfer fixing device according to claim 1, further comprising an actuator coupled to the pressure member and operatively connected with the roughness meter to displace the pressure member to reduce pressure against the transfer fixing member when the measured roughness falls below a given lower threshold.

9. The transfer fixing device according to claim 1, further comprising a secondary heater located adjacent to the moving surface of the transfer fixing member upstream of the transfer fixing nip to heat the toner image before entering the transfer fixing nip.

10. The transfer fixing device according to claim 1, further comprising a guide plate provided along the media conveyance path and at an upstream end of the transfer fixing nip.

11. The transfer fixing device according to claim 10, wherein the guide plate is a plate of thermally conductive material, the conductive material being at least one of copper and aluminum.

12. The transfer fixing device according to claim 10, wherein the guide plate further includes a heating element bonded thereon to generate conductive heat through the guide plate, the heating element being an electric heater with a positive temperature coefficient (PTC) of resistance.

13. The transfer fixing device according to claim 1, further comprising a brush pressure roller opposite the primary heater to increase thermal efficiency in preheating the recording medium.

14. The transfer fixing device according to claim 13, wherein the brush pressure roller includes a roller having an outer surface covered with at least one of a heat-resistance fibrous, a porous material, polyurethane foam, felt, and bristles.

15. The transfer fixing device according to claim 1, further comprising a belt cooling roller at a downstream end of the transfer fixing nip to absorb heat from a belt surface and distribute the heat uniformly across a width of the belt.

16. The transfer fixing device according to claim 1, wherein the pressure member generates a transfer field at the transfer fixing nip only when the recording medium in use has surface irregularities or roughness to which a trans-fixing belt cannot sufficiently conform.

17. An image forming apparatus, comprising an electrophotographic imaging unit to form a toner image; and a transfer fixing device to simultaneously transfer and fix a toner image onto a surface of a recording medium traveling along a media conveyance path, the device including:

a transfer fixing member defining a moving surface on which the toner image travels;

a pressure member pressed against the transfer fixing member to define a transfer fixing nip where the toner image traveling along the moving surface meets the surface of the recording medium traveling along the media conveyance path; and a primary heater located upstream of the transfer fixing nip along the media conveyance path to heat the surface of the recording medium before entering the transfer fixing nip, and a roughness meter disposed along the media conveyance path upstream of the transfer fixing nip and operatively connected with the pressure member to measure roughness of the surface of the recording medium before the recording media enters the transfer fixing nip, and to cause the pressure member to generate the electrostatic field only when the measured roughness exceeds a given upper threshold, wherein:

the heated surface of the recording medium melts and settles toner in place at the transfer fixing nip, and the pressure member is at least partially electrically biased to generate an electrostatic field to promote transfer of toner at the transfer fixing nip.

18. A transfer fixing device that simultaneously transfers and fixes a toner image onto a surface of a recording medium traveling along a media conveyance path, the device comprising:

a transfer fixing member defining a moving surface on which the toner image travels;

a pressure member pressed against the transfer fixing member to define a transfer fixing nip where the toner image traveling along the moving surface meets the surface of the recording medium traveling along the media conveyance path;

a primary heater located upstream of the transfer fixing nip along the media conveyance path to heat the surface of the recording medium before entering the transfer fixing nip, and a roughness meter disposed along the media conveyance path upstream of the transfer fixing nip and operatively connected with the pressure member to measure roughness of the surface of the recording medium before the recording media enters the transfer fixing nip, and to cause the pressure member to generate the electrostatic field only when the measured roughness exceeds a given upper threshold, wherein:

the heated surface of the recording medium fuses toner for transfer and fixes into place at the transfer fixing nip, and the pressure member is electrically biased to generate an electrostatic field to promote transfer of toner at the transfer fixing nip at least downstream from where pressure against the transfer fixing member is at a maximum across the transfer fixing nip.

* * * * *